US005916525A

United States Patent [19]

Husar et al.

[11] Patent Number: 5,916,525

[45] Date of Patent: Jun. 29, 1999

[54] CLOSURE VESSEL ASSEMBLY

[75] Inventors: Dieter Husar, Hamburg; Karl Baldszun, Schenefeld; Oliver Beer, Hamburg, all of Germany

[73] Assignee: Eppendorf-Netheler-Hinz GmbH, Hamburg, Germany

[21] Appl. No.: 07/984,762

[22] Filed: Dec. 3, 1992

[30] Foreign Application Priority Data

Dec. 3, 1991 [DE] Germany ..... 41 39 810

[51] Int. Cl.[6] ..... B01L 3/00

[52] U.S. Cl. ..... 422/102; 422/104

[58] Field of Search ..... 422/102, 104

[56] References Cited

U.S. PATENT DOCUMENTS

| | | | |
|---|---|---|---|
| 3,371,808 | 3/1968 | Velt | 215/9 |
| 3,607,098 | 9/1971 | Strande | 422/102 |
| 4,202,455 | 5/1980 | Faulstich | 215/31 |
| 4,241,188 | 12/1980 | Materia et al. | 422/102 X |
| 4,526,756 | 7/1985 | Wong | 422/104 |
| 4,654,127 | 3/1987 | Baker et al. | 422/102 |
| 4,713,219 | 12/1987 | Gerken et al. | 422/102 |
| 4,755,356 | 7/1988 | Robbins et al. | 422/102 |
| 4,896,780 | 1/1990 | Jessop et al. | 215/291 |
| 4,953,741 | 9/1990 | Jessop et al. | 220/273 |
| 4,956,103 | 9/1990 | Jessop et al. | 210/787 |
| 5,128,104 | 7/1992 | Murphy et al. | 422/102 |
| 5,145,646 | 9/1992 | Tyranski | 422/102 |
| 5,167,929 | 12/1992 | Korf et al. | 422/102 |

FOREIGN PATENT DOCUMENTS

| | | |
|---|---|---|
| 0279126 | 8/1988 | European Pat. Off. . |
| 0376435 | 7/1990 | European Pat. Off. . |
| 0439842 | 8/1991 | European Pat. Off. . |
| 2166422 | 5/1986 | United Kingdom . |

*Primary Examiner*—Harold Y. Pyon
*Attorney, Agent, or Firm*—Anderson, Kill & Olick, P.C.

[57] ABSTRACT

A closure vessel assembly for use in laboratory work within a range of temperature from −196° C. to 100° C. above zero includes a vessel made of a plastic material and having a wall defining the vessel mouth, and a closure for closing the vessel. The closure has an annular sealing lip which depends from the top wall of the closure and extends into the vessel mouth when the closure is locked on the vessel. The sealing surface of the sealing lip engages the sealing surface of the vessel wall, in the locked position of the closure with the vessel, to provide a seal therebetween. The respective radii of the sealing surfaces of the sealing lip and the wall are selected so as to provide for minimum surface pressure yet sufficient sealing between the sealing surfaces, despite any deformation of the materials of the sealing surfaces during the required closing time of the vessel.

7 Claims, 5 Drawing Sheets

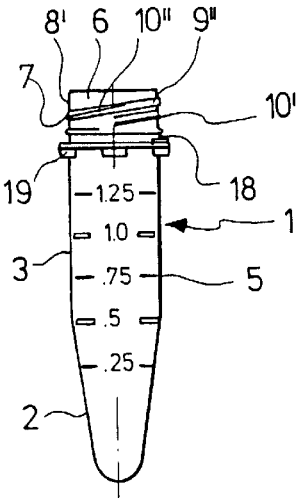
FIG.1
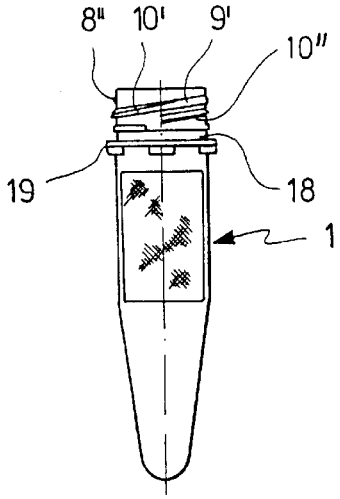
FIG.2
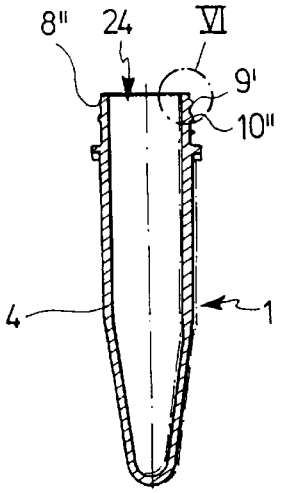
FIG.3
FIG.4
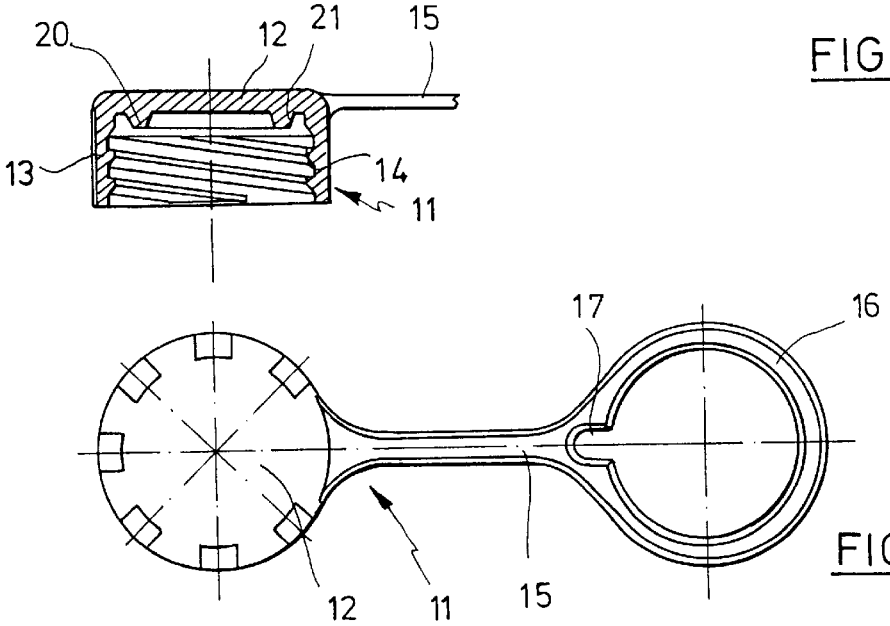
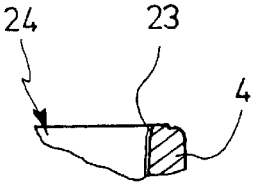
FIG.6
FIG.5

CLOSURE VESSEL ASSEMBLY

FIELD OF THE INVENTION

The present invention relates to a closure vessel assembly as well as to a closure and a vessel for such an assembly.

BACKGROUND OF THE INVENTION

In particular, the present invention relates to vessels for use in laboratory work at extreme temperatures, which vessels have fluid volumes in the order of up to a few milliliters. Conventional vessels generally are vessels of the screw-threaded closure vessel type and are provided with separate sealing elements such as an O-ring. Such a vessel structure may result in contamination of the contents of the vessel when the material of the O-rings has been damaged by aggressive fluids contents. Furthermore the additional sealing element causes specific production costs.

In a prior art closure vessel assembly the closure is provided with a sealing lip having a shape of an extended parabola in a longitudinal cross-section. At its periphery the sealing lip is provided with a lip sealing surface which is resiliently and sealingly urged against an internal rim of the mouth of the vessel when the closure is in screw-threaded engagement with the vessel. At the internal rim a housing face wall and a housing side wall abruptly merge into each other, i.e. the radius of curvature of the internal rim approximates zero in a longitudinal cross-section. Accordingly, the lip sealing surface is subjected to an annular line contact resulting in substantial surface pressures. Such surface pressures cause the lip seal to be deflected inwardly for a substantial amount when the closure is in screw-threaded engagement with the vessel.

Such sealing structure is not very critical at room temperature. If, however, the vessel is used in a wide range of temperatures of e.g. −136° C. to +100° C., the closure vessel assembly will experience critical conditions during the required closure time. In particular at high temperatures there will be a substantial deformation of the material of the sealing means resulting in a reduction of the sealing forces along with a corresponding leakage of the fluid contents of the vessel. This situation is aggravated by the increase of vapor pressure of the probes at the higher temperatures which may attain 100° C. when the vessel is immersed in a hard water bath. Low temperatures such as −196° C. which are encountered when using liquid nitrogen as a cooling medium result in a plastic deformation of the plastic vessel in particular in the prestressed sealing area. As a result the cooling medium may leak into the vessel and may evaporate causing rupturing of the closure. This may result in environmental contamination.

SUMMARY OF THE INVENTION

It is an object of the present invention to provide an improved vessel closure assembly having excellent sealing characteristics under extreme temperature conditions such as temperatures from preferably −196° C. to +100° C. during a desired closure time of e.g. 20 minutes.

According to one aspect, the present invention provides a closure vessel assembly, in particular for use in laboratory work within a wide range of temperatures, the assembly comprising a vessel and a closure of plastics material, said vessel having a wall and an upper mouth and said closure having a top wall, said vessel and said closure being provided with locking means effective therebetween and sealing means for providing a fluid tight seal therebetween, said sealing means including an annular sealing lip depending from the closure top wall and extending into said vessel mouth, said sealing lip having a sealing surface in sealing engagement with a sealing surface on said vessel wall, said lip sealing surface and said vessel sealing surface in a longitudinal cross-section having radii of curvature such as to provide for minimum surface pressure yet sufficient sealing between said sealing surfaces despite any deformation of the materials of said sealing surfaces during the required closing time of the vessel.

According to another aspect the present invention provides a closure vessel assembly, in particular for use in laboratory work within a wide range of temperatures, the assembly comprising a vessel and a closure of plastic materials, said vessel having a wall and an upper mouth and said closure having a top wall, said vessel and said closure being provided with locking means effective therebetween and sealing means for providing a fluid tight seal therebetween, said sealing means including an annular sealing lip depending from the closure top wall and extending into said vessel mouth, said sealing lip having a sealing surface in sealing engagement with a sealing surface on said vessel wall, said sealing lip comprising an extension enhancing engagement between said lip sealing surface and said vessel sealing surface due to superatmospheric pressure within the vessel so as to improve the sealing action therebetween.

Surprisingly, it was found that a small surface pressure at the sealing surfaces as provided by the present invention, on the one hand, may be sufficient to provide a fluid tight seal within the desired temperature range and, on the other hand results in such a small plastic deformation of the materials during the desired closure time that the sealing function is not detrimentally affected but provides for a sufficient minimum sealing tightness. This approach is materially different from that of the prior art sealing techniques which had been based on the assumption that a high surface pressure is necessary for providing a fluid tight seal. According to the first aspect of the present invention a small surface pressure is obtained by appropriate selection of the radii of curvature of the lip sealing surface and vessel sealing surface as seen in a longitudinal cross-section of the closure and vessel assembly.

Basically, the minimum surface pressure is obtained by having both infinite radii of curvature, i.e. the lip sealing surface and the vessel sealing surface are having line contact with each other as seen in a longitudinal cross-section. However, such a sealing structure might cause problems, in particular manufacturing tolerances in the manufacture of the sealing surfaces and/or damage to the sealing surfaces may result in loss of sealing quality. According to a preferred embodiment of the present invention only one of the radii of curvature of the lip and vessel sealing surfaces is selected to be infinite. The other of the radii of curvature of the lip and vessel sealing surface is of a smaller value which is still sufficiently greater than zero. Such a combination of radii of curvature of the lip and vessel sealing surface allows to obtain small surface pressures and to compensate for inaccuracies in the dimensions of the sealing surfaces and/or damage to the sealing surfaces, in particular to the sealing surface having the smaller radius of curvature. Preferably, the smaller radius of curvature is provided at the vessel sealing surface which is more likely to be damaged. Providing the vessel sealing surface on the internal rim of the vessel mouth results in an improved protection against damages and contamination of the sealing surfaces. It is to be pointed out that the language "infinite" and "substantially greater" should be understood figuratively, having in mind the size of the surfaces involved. Thus, a radius of 1 mm for the sealing surface of a vessel having a volume of, e.g., 1.3 ml, may be considered as being "substantially greater than zero", and a smaller radius of curvature of about 1 mm has shown to provide for excellent results.

In order to further reduce the likeliness of material deformations at extreme temperatures the stiffness of the sealing lip is chosen so that the sealing lip when under surface pressure is subjected only to a small resilient deformation which nevertheless is sufficient to obtain a desired sealing force and to compensate for manufacturing or other errors. This will further reduce the speed of deformation of the sealing lip in the respective load situations. The desired stiffness of the sealing lip is preferably obtained by the shape and dimensions thereof and the type of material used. To this end the sealing lip may be designed so that it will be of a compact shape, for example by having its height not exceed the width of its base. Furthermore a truncated shape of the sealing lip cross-section may have a favorable influence on its deformation behavior. Furthermore an acute angle of inclination of the lip sealing surface from the closure top surface towards the longitudinal axis of the vessel will provide for an improved error compensation and an increase of the adjustment range for the surface pressures due to a radial deformation of the sealing lip.

In the closure vessel assembly according to the second aspect of the present invention the length of the sealing lip is selected so that its lip sealing surface is urged against the vessel sealing surface due to an overpressure within the vessel as caused by the vapor pressure of the fluid probe within the vessel. The resulting plastic deformation of the materials under the actual temperature conditions is being used to enhance or at least maintain the sealing which originally was effected by a resilient biasing of the sealing lip. In this connection it is of advantage that the sealing is obtained substantially independently of any locking forces between the closure and the vessel; this is particularly true if the sealing lip is urged against the vessel sealing surface in a radial direction.

To improve the above mentioned effects the sealing lip surface and the vessel sealing surface are provided adjacent the free end of the sealing lip. Preferably, the vessel sealing surface is provided at a portion of the vessel wall of reduced cross-section. Furthermore, an arrangement wherein the sealing lip surface extends substantially parallel to the longitudinal axis of the vessel is preferred.

In the closure vessel assembly according to both aspects of the present invention, the closure top surface is preferably of a stiffness so as to prevent or reduce any deflections thereof due to pressure forces in order to prevent any disengagement of the lip sealing surface from the vessel sealing surface. To this end the closure top surface preferably is of a substantial wall thickness.

In order to prevent or reduce any undesired flow of material which might detrimentally affect the sealing, said vessel wall is surrounded by an annular member closely adjacent to said vessel sealing surface without any space therebetween.

Preferably said locking means comprise locking elements at an internal side of a closure side wall and on an external side of said vessel wall. Accordingly, the locking elements are not in contact with the contents of the vessel. Preferably the locking elements comprise helical threads. This allows for a precise adjustment of the surface pressures. If the locking elements comprise snap-on elements for a presnapping action, the snapping function is simplified and yet fine adjustment of the surface pressures is still possible. To this end said threads comprise multiple threads on each of said vessel wall and said closure sidewall and one of said multiple threads on each of said vessel wall and said closure side wall comprises an initial portion of reduced height extending along a fraction of a turn of the respective thread so as to serve as snap-on elements adapted to be brought into snapping engagement with each other. Accordingly the initial portion of the threads close to the vessel mouth are used for the pre-snapping action and the other portions of the threads are used for the locking action. Preferably, said sealing lip extends beyond said closure side wall in a longitudinal direction of said vessel which will facilitate to introduce the sealing lip into the vessel mouth.

The vessel may be made from a polyolefin such as polypropylene or polyethylene. Also combinations of various polyolefins for the closure and the vessel may be used. Furthermore fluorpolymers such as polytetrafluorethylene may be used in particular in connection with the handling of very aggressive substances. With a view of an increased stiffness of the sealing lip and closure top wall it might be preferable to provide that the closure has a modulus of elasticity in excess of that of the vessel. This may be obtained by the selection of appropriate plastics or their composition e.g. by using specific additives.

As may be seen from the above, the present invention provides for the required sealing under the desired conditions without the use of separate sealing elements such as O-rings and without the respective manufacturing and mounting expenditure. Furthermore, the present invention overcomes the contamination problems of the prior art. The vessel according to the present invention is used in particular as a safety vessel (centrifuging) as a vessel for storing and/or transporting fluid probes, as a cryo-vessel and as a vessel for denaturation of albumen in a water bath of 100° C.

BRIEF DESCRIPTION OF THE DRAWINGS

The invention together with additional objects, features and advantages thereof will be best understood from the following description, the depended claims and the accompanying drawings in which:

FIG. 1 is a side elevation of a vessel having a vessel sealing surface on an internal rim of the vessel mouth;

FIG. 2 a side elevation of the vessel shown in FIG. 1 which, however, has been rotated about 90°;

FIG. 3 is a longitudinal cross-section of the vessel shown in FIG. 1 and 2;

FIG. 4 is a partial longitudinal cross-section of a closure for the above vessel in an enlarged scale;

FIG. 5 is a top view of the closure shown in FIG. 4;

FIG. 6 is a view of the detail as indicated by the dash dotted circle VI in FIG. 3 in an enlarged scale;

DESCRIPTION OF THE PREFERRED EMBODIMENT

Figure 7:
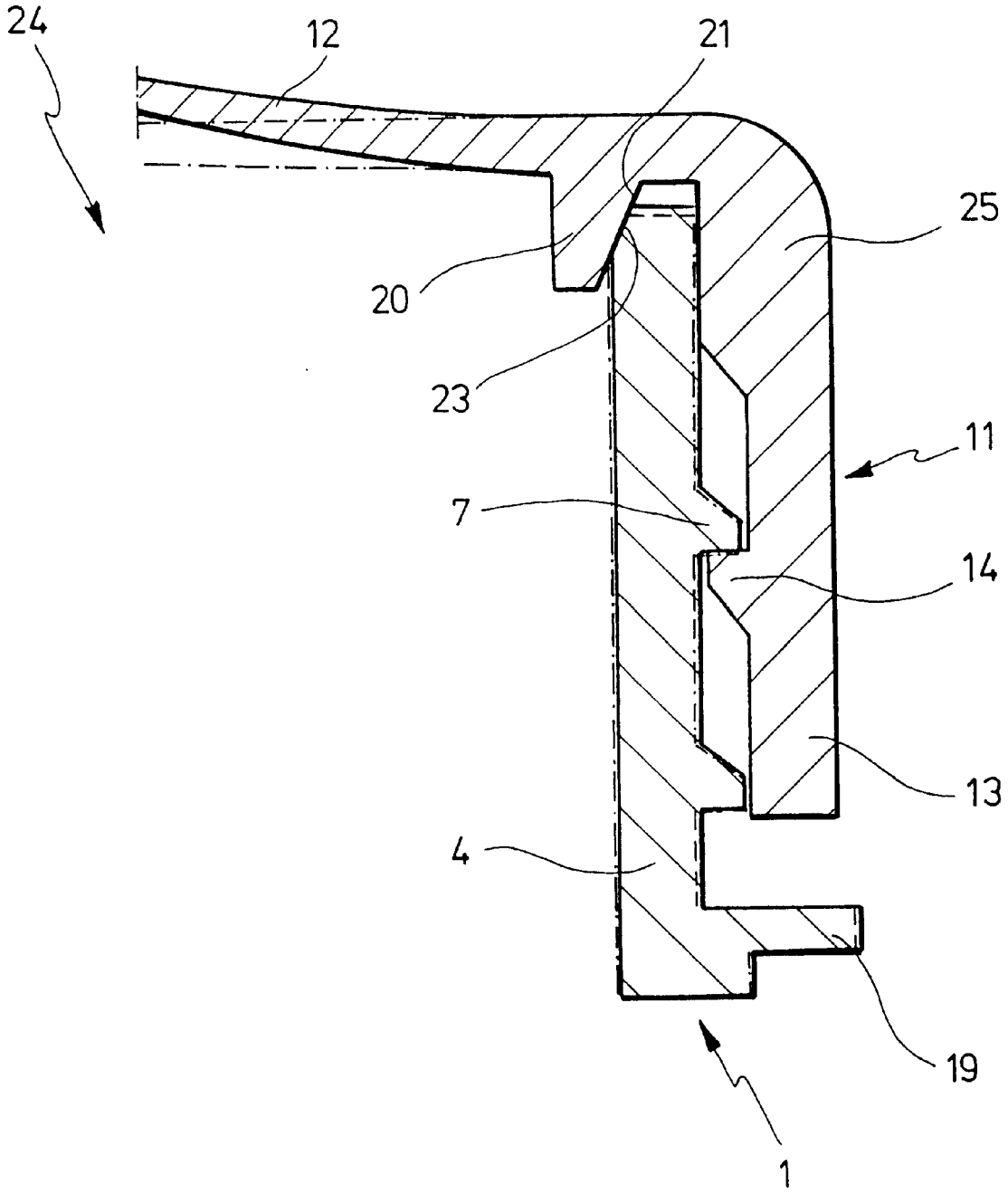
FIG. 7 a diagramatic partial cross-section to show the cooperation between the vessel and closure of FIG. 1 to 6 when under pressure.

FIG. 1 to 3 show a vessel 1 of a closure vessel assembly in accordance with the present invention. The vessel 1 which is of a volume of 1.3 ml includes a tapered bottom portion 2 and a cylindrical main portion 3. The vessel 1 includes, in the area of portions 2 and 3, a vessel wall 4 having level indicating marks 5.

Furthermore, the vessel at its upper end includes a threaded portion 6 comprising a pair of threads 7. As may be seen from FIG. 1 and 2 the initial portions 8,8" of the pair of threads of the threaded portion 6 are offset with respect to each other about 90°. Furthermore it may be seen from these figures that initial portions 9,9" of the threads are of a reduced height over a quarter of the threaded portion 6. It is only the following thread sections 10,10" that have a distinct saw tooth profile over a half circumference of the threaded portion 6.

The threaded portion 6 of the vessel cooperates with a closure 11 as shown in FIG. 4 and 5. Closure 11 includes a top wall portion 12 merging at its outer periphery into a cylindrical closure wall 13. Closure wall 13 is provided with a pair of internal threads 14 having a continuous saw tooth profile from the beginning to the end of the threads. The closure 11 is arranged to have the initial areas of its two threads to be snapped on the initial sections 9,9" of the threads 7 of the vessel 1; thereafter the closure 11 may be rotated to be brought into full threaded engagement with the saw tooth profile thread portions 10,10" to fully interlock the closure with the vessel.

Before the closure 11 is interlocked with the vessel 1, the closure may be connected to the vessel 1 by means of a flexible flap 15 integrally connected to one side of the closure; to this end a flap eyelet 16 having an extension area 17 is engaged into an external groove 18 of vessel 1. Below the groove 18 the vessel 1 is provided with an integral annular member 19 which serves an abutment both for the flap eyelet 16 and the threaded portion of the closure.

The interlocking engagement between the closure 11 and the vessel 1 also provides a sealing action between these components. The respective sealing means comprises, as shown in FIG. 4, an annular sealing lip 20 depending from the closure top wall 12, concentric to the longitudinal axis of the closure and being of truncated shape in a longitudinal cross-section. The outer flanks of the truncated sealing lip 20 comprise lip sealing surfaces 21 which are inclined to the longitudinal axis of the closure 11 about an angle of 25°. The radius of curvature of the lip sealing surface 21, when viewed in a longitudinal cross-section, is infinite, so that the lip sealing surface 21 is practically a straight line.

The sealing lip 20 cooperates with a vessel sealing surface 23 provided on an internal rim of a vessel mouth 24 as shown in FIG. 3 and 6. The vessel sealing surface 23 has a radius of curvature of 1 mm as seen in a longitudinal cross-section.

Details of the sealing means and the cooperation of the threaded interlocking means will be explained in more detail with reference to FIG. 7 to 9. In these figures the closure vessel assembly is shown by dash dotted lines in a condition when the closure 11 has been removed and before there is any superatmospheric pressure within the vessel due to a temperature rise, and the closure vessel assembly is shown in straight lines in a condition when an overpressure has been built up within the vessel after a closure time of about 20 minutes.

As shown in FIG. 7 the closure top wall 12 has been deformed outwardly due to flow of material in response to pressure forces, resulting in a slight displacement of the lip sealing surface 21 and the vessel sealing surface 23. Nevertheless, the sealing effectiveness is still acceptable because the selected radii of curvature of the sealing surfaces 21 and 23 result in low surface pressures and in an only slight deformation of the used materials which is assisted by slightly prestressing the sealing lip 20. Furthermore, an annular member 25 which is integral with the closure side wall 13 and which supports the vessel wall 4 close to the vessel mouth 24 from the outside, additionally counteracts any deformation in the area of the sealing means.

Figure 8:
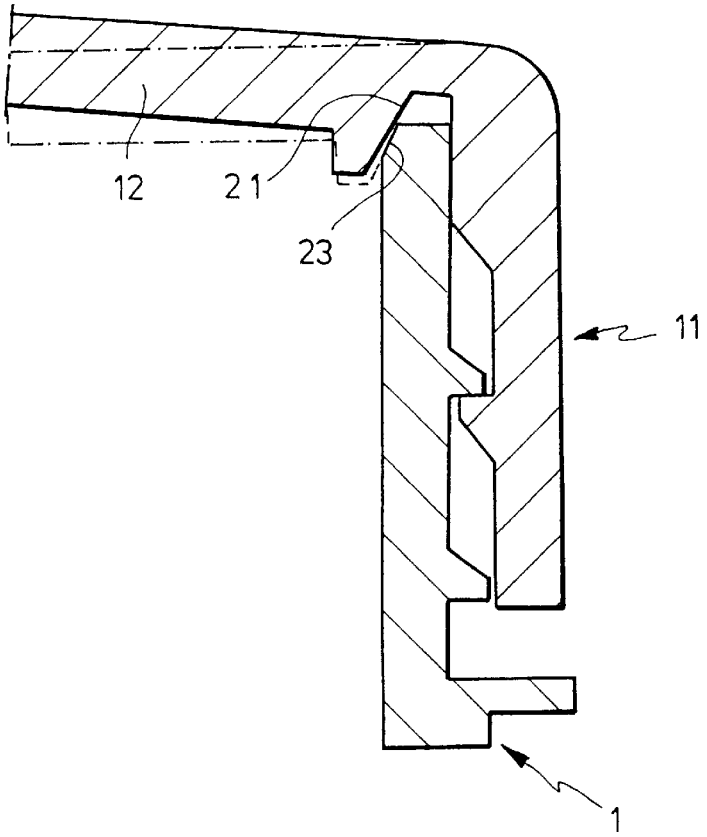
FIG. 8 a view corresponding to FIG. 7 showing a modified closure having a closure top wall of increased stiffness.

In FIG. 8 the closure 11 has been modified to have a top wall 12 of increased thickness reducing any deflections due to an internal pressure within the closure vessel assembly, thus reducing any impairment of the sealing effectiveness between the lip sealing surface 21 and the vessel sealing surface 23. In this modified embodiment impairment of the sealing effectiveness is still relatively substantial because a material having a modulus of elasticity of 250 $N/mm^2$ has been used for the closure 11 and a material having a modulus of elasticity of 500 $N/mm^2$ has been used for the vessel 1.

Figure 9:
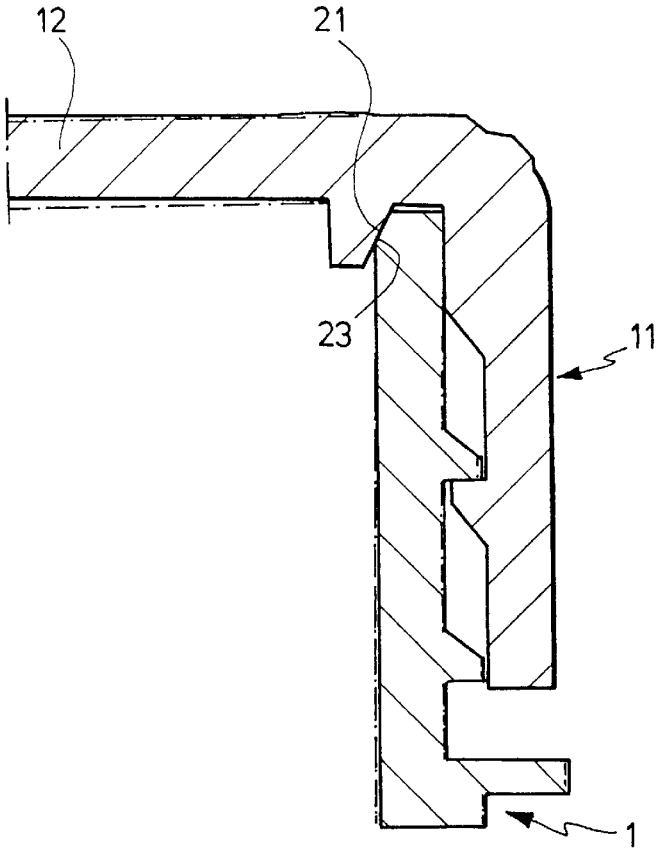
FIG. 9 a view corresponding to FIG. 8 of a somewhat modified version of the closure and vessel.

In the embodiment of FIG. 9 wherein the wall thickness of the closure top wall 12 is the same, the moduli of elasticity of the materials of the vessel and closure have been reversed, i.e. the modulus for the closure 11 is 500 $n/mm^2$ and the modulus for the vessel 1 is 250 $N/mm^2$. As a result, deflection of the closure top wall 12 and deformation of the sealing surfaces 21 and 23 have been substantially reduced.

Figure 10:
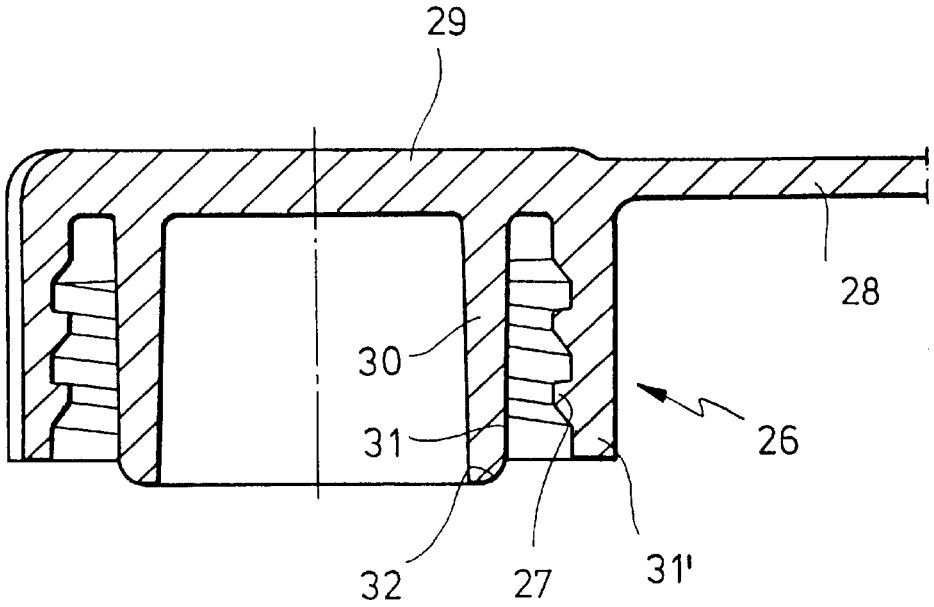
FIG. 10 is a longitudinal cross-section of a closure having a sealing lip of increased length in accordance with a second aspect of the present invention.
Figure 11:
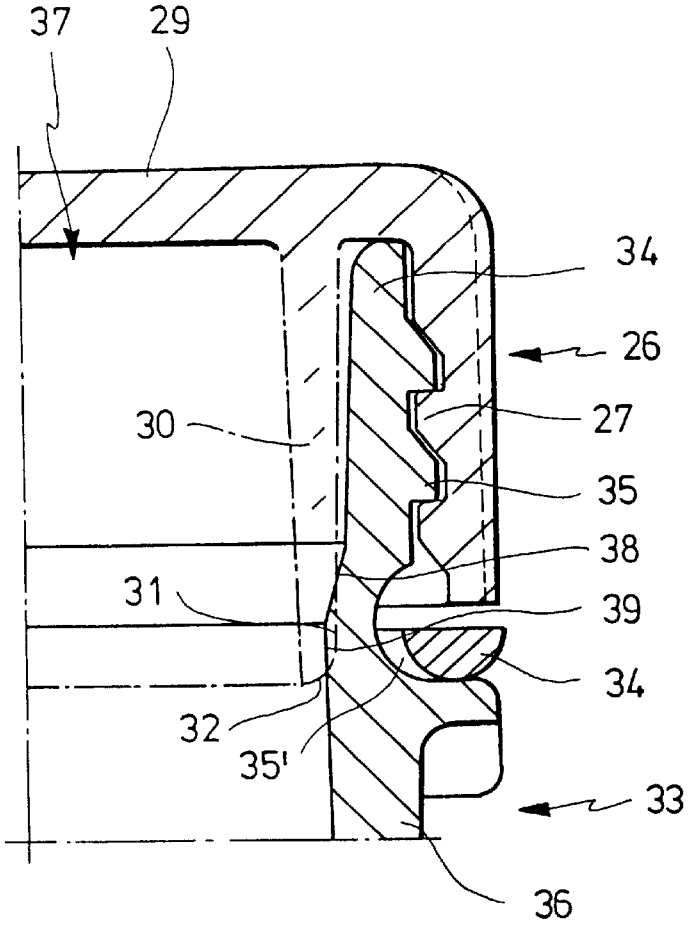
FIG. 11 is a longitudinal cross-section of a closure vessel assembly including a closure according to FIG. 10.

FIG. 10 shows another embodiment of a closure vessel assembly including a closure 26 having internal threads 27 and a connection flap 28 adapted to cooperate with a threaded portion 6 and a groove 18 of the embodiment shown in FIG. 1 to 3. However, in the closure 26 a sealing lip 30 depending from the closure top wall 29 is provided which extends beyond the closure side wall in parallel to the longitudinal axis of the closure. The sealing lip 30 is provided with an external cylindrical lip sealing surface 31 having a small radius 32 at the free end of the sealing lip so as to facilitate insertion of the sealing lip into a vessel mouth. FIG. 11 shows an associated vessel 33 having at its upper end a threaded portion 34 with threads 35 similar to those shown in FIG. 1 to 3. Threads 35 of vessel 33 are interlocked with threads 27 of the closure 26, the closure flap 28 having its eyelet 34 secured in a groove 35' of the vessel 33.

A wall 36 of the vessel 33 is provided, at a location spaced from a vessel mouth 37, with a chamfer 38 so that the wall 36 has a reduced cross-section in this area. At its lower end, the chamfer 38 is followed by a sealing surface 39 comprised of a cylindrical inner surface of the vessel wall 36. At a location below vessel sealing surface 39 the vessel wall 36 is slightly recessed. In FIG. 11 the sealing lip 30 of the closure 26 is shown, by dash dotted lines, in its original condition when it has not been deformed. However, it is to be noted that the sealing lip 30 when it is inserted into the vessel mouth 37 is resilently deflected inwards as soon as its radius 32 and the lip sealing surface engage the chamfer 38 and thereafter the vessel sealing surface 39.

Figure 12:
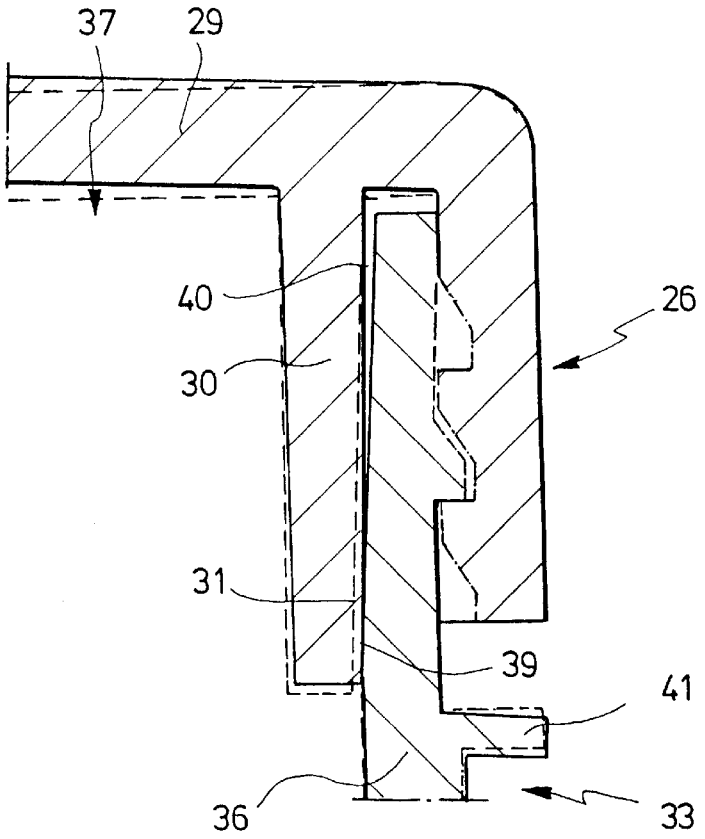
FIG. 12 is a view similar to FIG. 11 showing a deformation on the closure vessel assembly.
Figure 13:
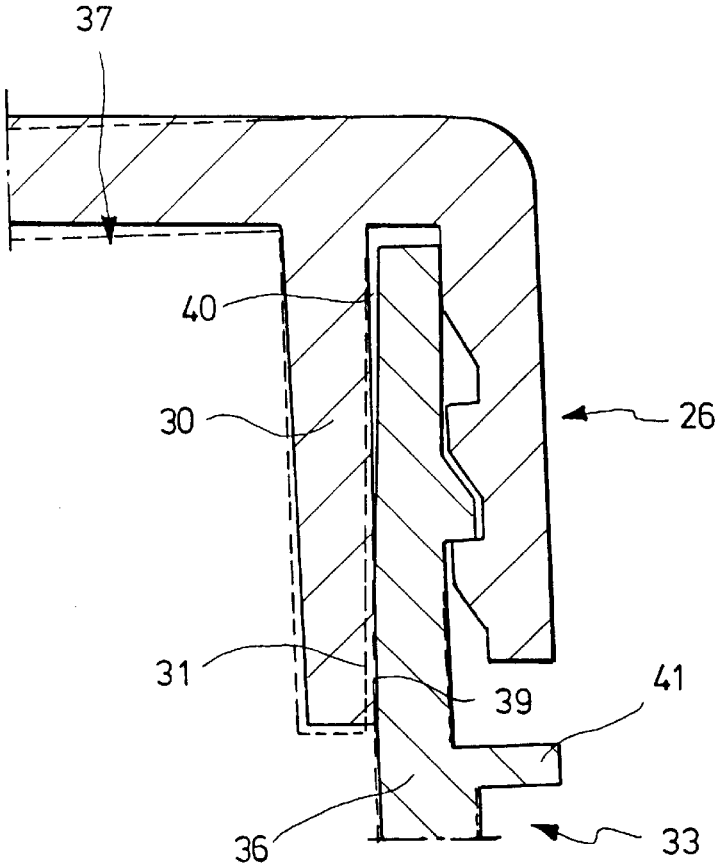
FIG. 13 a view similar to FIG. 12 showing a deformation of the closure vessel assembly after an extended period of time.

FIG. 12 and 13 show the closure vessel assembly in a condition where the sealing lip 30 has been deflected inwardly; the initial deflection or deformation has been indicated by dotted lines and the deflection or deformation after a certain closure time has been indicated by full lines. At the time of the initial deformation the sealing lips 30 have only their lip sealing surface 31 engage the vessel wall 36 in the area of the vessel sealing surface 39. Even though there is no internal pressurization of the vessel at this time, the resilient biasing of the sealing lip 30 provides for a surface pressure between the sealing surfaces 31 and 39 which is sufficient to ensure a fluid tight seal. A gap 40 between the sealing lip 30 and the vessel wall 36 extends from the sealing surface 31,39 to the vessel mouth 37 so as to provide a space into which the sealing lip may be deformed.

When the pressure within the vessel rises due to a temperature increase of the fluid probe, a plastic deformation of the sealing lip 30 in a radially outward direction results. A maximum deformation occurs in the area towards the free end of the sealing lip so that the surface pressure between the sealing surfaces 31, 39 increases or at least is maintained. An annular member which in the drawing is an integral annular flange 41 is provided to prevent the vessel wall 36 to be expanded which otherwise would cause a reduction of the surface pressure between the sealing surfaces 31, 39.

FIG. 12 shows, additionally to the initial deformations, the deformation after about one minute, while FIG. 13 shows additionally to the initial deformation, the final deformation after about one hour. It should be appreciated that the deformation speed is rapidly reduced to small values, and approximately constant sealing conditions will be reached.

The deformation behaviour as indicated in FIG. 7 to 9 and FIG. 12, 13 has been calculated by using the FEM (Finite Elements Method), with the calculations having been based on the characteristics of a polyolefin. The closure vessel assembly in accordance with the present invention allows to obtain a loss rate of less than 0.3% (i.e. less than 3.9 mg loss of liquid) with a probe volume of 1.3 ml in a water bath at 100° C. and for a closure time of at least 30 minutes.

We claim:

1. A closure vessel assembly for use in laboratory work within a range of temperature between −196° C. and +100° C., and capable of maintaining required sealing characteristic within said temperature range for at least 20 min, the vessel assembly comprising;

a vessel made of a plastic material and having a wall which defines an upper mouth, and a fluid volume of up to several milliliters;

a closure made of a plastic material for closing said vessel and having a top wall and a side wall;

means for locking said closure with said vessel, and sealing means located between said vessel and said closure, wherein said sealing means comprises an annular sealing lip dependent from said top wall of said closure and having a lip sealing surface, and a convex sealing surface formed on said wall of said vessel and engageable by said lip sealing surface;

wherein said lip sealing surface extends from said top wall at an acute angle toward a central axis of said vessel and has an infinite radius of curvature, and said convex sealing surface has a radius of 1 mm;

wherein said locking means comprises cooperating helical threads formed on an internal surface of said side wall of said closure and on an external surface of said wall of said vessel;

wherein said convex sealing surface is formed on an internal rim of said wall of said vessel; wherein said closure has a modules of elasticity and wherein said sealing lip has a truncated shape.

2. The closure vessel assembly of claim 1, wherein said sealing lip has a stiffness permitting a small resilient deformation under pressure.

3. The closure vessel assembly of claim 1, wherein said sealing lip has a base and a height equal to the width of said base.

4. The closure vessel assembly of claim 1, wherein said top wall of said closure has a stiffness, which permits it to withstand at least one of a sealing surface pressure and a superatmospheric pressure.

5. The closure vessel assembly of claim 1, further comprising an annular member mounted on said wall of said vessel closely adjacent to said convex sealing surface.

6. The closure vessel assembly of claim 1, wherein said locking means further comprises snap-on means for providing initial snapping between said closure and said vessel.

7. The closure vessel assembly of claim 1, wherein said vessel and said closure are formed of one of a polyolefin and a fluoropolymer.

* * * * *